US005802750A

United States Patent [19]

Fulmer

[11] Patent Number: 5,802,750

[45] Date of Patent: Sep. 8, 1998

[54] DEVICE FOR SIMULATING FLYING FISH

[75] Inventor: Paul F. Fulmer, Plantation, Fla.

[73] Assignee: Autopilot Systems, Inc., Ft. Lauderdale, Fla.

[21] Appl. No.: 651,699

[22] Filed: May 21, 1996

[51] Int. Cl.[6] ..... G09F 19/00

[52] U.S. Cl. ..... 40/406; 40/439; 239/23; 239/99

[58] Field of Search ..... 40/406, 407, 409, 40/412, 439; 239/17, 18, 20, 22, 23, 103, 383, 99

[56] References Cited

U.S. PATENT DOCUMENTS

| | | | |
|---|---|---|---|
| 428,113 | 5/1890 | Layman . | |
| 3,664,585 | 5/1972 | Curtis . | |
| 3,713,587 | 1/1973 | Carson | 239/383 |
| 3,806,033 | 4/1974 | Daugherty . | |
| 4,426,021 | 1/1984 | Rosenthal | 40/439 X |
| 5,165,580 | 11/1992 | Rosenthal | 40/439 X |

FOREIGN PATENT DOCUMENTS

| | | |
|---|---|---|
| 393509 | 6/1933 | United Kingdom . |

*Primary Examiner*—Brian K. Green
*Attorney, Agent, or Firm*—Clifford A. Poff

[57] ABSTRACT

Disclosed is an apparatus for simulating a flying fish which includes a pump, piping connected to the pump, a tube bundle connected to an end of the piping opposite from the pump for dividing pressurized water within the piping into parallel section of flowing water thereby creating a columnarized flow, a rotating disc having apertures located adjacent to an end of the tube bundle from which the divided flow of water is ejected, the rotating disc creating alternating portions of deflected and projected water, the projected portions simulating a flying fish, particularly when the apparatus is situated in a first body of water and the projected portions are directed at a second body of water.

16 Claims, 4 Drawing Sheets

DEVICE FOR SIMULATING FLYING FISH

BACKGROUND OF THE INVENTION

1. Field of the Invention

The present invention relates to flow stream controlling apparatus, and, more particularly, to an apparatus for creating discrete portions of projected liquid to serve as an effective illusion for amusement purposes.

2. Description of the Prior Art

Devices which incorporate the impingement of a fluid stream, or a portion thereof, for a variety offend purposes, are well known in the art.

A common area for such devices involves water sprinkler systems in which a stream of water is directed at a vaned wheel, such as in U.S. Pat. No. 428,113 to Layman and British Patent No. 393,509 to Reiter, for redirection of the flow stream in a number of directions. These systems, however, have as an end goal, maximum dispersion of the water over a given surface area, and not the creation of discrete portions of projected water directable at a specific target area.

Other systems incorporate impinging means for separation of a flow stream into discrete pulses for various purposes, such as therapeutic massage (U.S. Pat. No. 3,664,585 to Curtis), and cleaning or cutting streams (U.S. Pat. No. 3,806,033 to Daugherty). These systems achieve their ends through the use of high velocity pulses for which the impacting force of the pulses is the important criteria and for which the visual profile of the pulse shape is generally irrelevant.

In a system for simulating the appearance of a projected object, such as a flying fish, using a water stream, not only must the stream be divided into discrete lengths of projected water, control over the surface profile of the projected stream becomes important for enhancing the simulation. The greater the cohesiveness of the projected stream, the better will be the resulting illusion.

Accordingly, it is an object of the present invention to provide an apparatus capable of producing a highly columnar flow for producing a projected liquid having a cohesive appearance.

SUMMARY OF THE INVENTION

According to the present invention there is provided an apparatus for generating discrete portions of projected liquid for creating a visual illusion, the apparatus including a pump for placing a supply of the liquid under pressure, and piping having a first end connected to said pump and an opposite second end. The apparatus also includes means attached to the second end of the piping for dividing the liquid into parallel sections of flowing liquid thereby creating a columnarized stream, such as may be provided by a tube bundle, the means for dividing having an end from which the pressurized liquid is ejected. The apparatus further including means adjacent to the end of the means for dividing for impinging on the ejected liquid and deflecting a portion thereof, as may be provided by a rotating disc having apertures, the means for impinging allowing a portion of the liquid to be projected generally unimpeded, the deflected portions and the projected portions alternating such that each of the projected portions of liquid has a discrete length. The apparatus further including a tubular spray deflector aligned with the projected portions for containing spray associated with contact of an edge of the aperture with the columnarized stream. The apparatus, when situated in a first body of water, such as a pool, and having the projected liquid directed at a second body of water, such as a pool or fountain, serves to enhance the illusion of the projected liquid as a flying fish.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
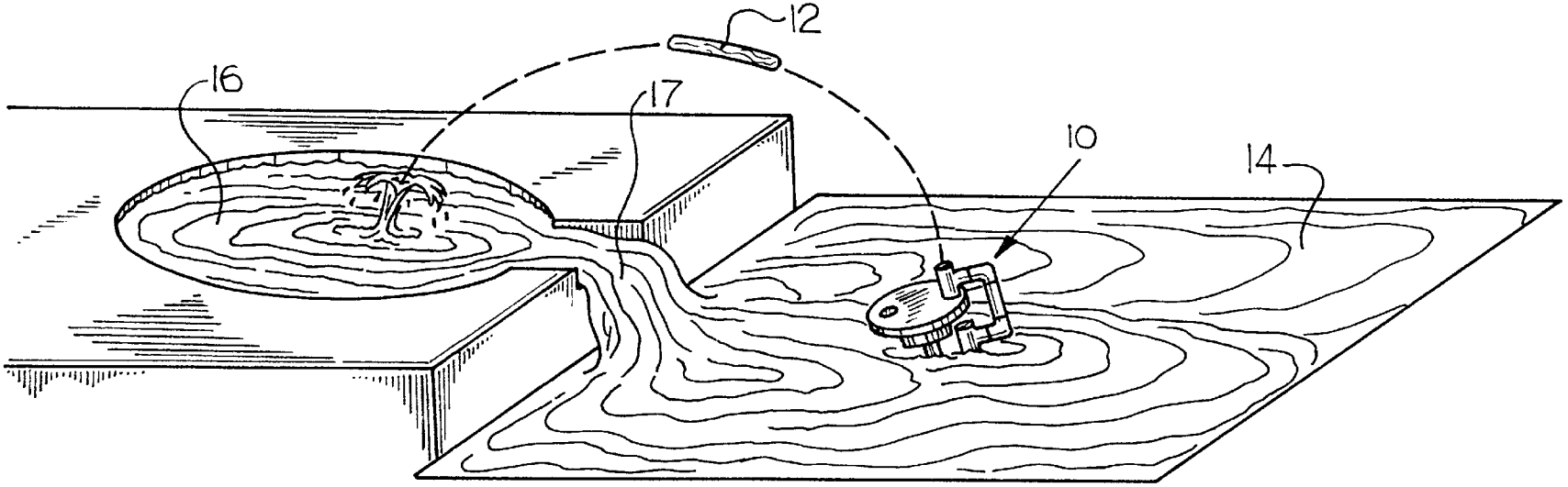
FIG. 1 is a perspective view showing the present invention in use with a swimming pool/spa combination.

Referring to FIG. 1, there is shown an apparatus 10 which simulates flying fish by generation of discrete portions of projected liquid 12. The apparatus 10 is shown situated in a first body of water 14 which could be a swimming pool, pond or other suitable body of water. The projected liquid portions 12 are shown directed at a second target body of water 16 which could be a spa, pool or fountain. The target body 16 is shown to have a surface which is at an elevation above the elevation of the surface of the first body of water 14. The target body of water could also be located at the same elevation, or at a lower elevation, with respect to the first body of water, and still function to provide the illusion of flying fish. The location of the target body at a higher elevation, however, together with an over flow stream 17 flowing from the target 16 to the first body 14, although not required, would serve to enhance the illusion of flying fish, as in salmon swimming upstream.

Figure 2:
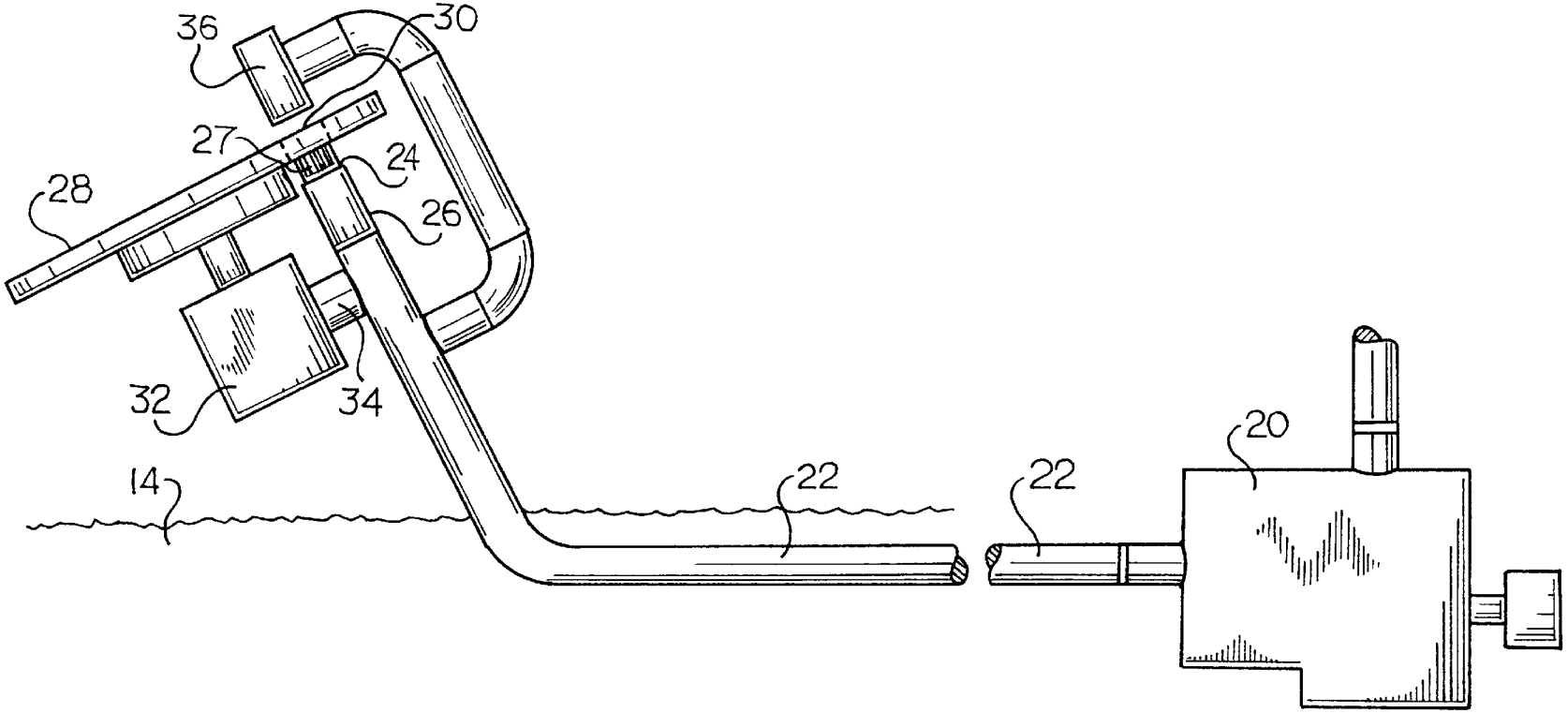
FIG. 2 is a partial elevational view of the present invention.

Turning to FIG. 2, the apparatus 10 is shown in greater detail. The apparatus includes a pump 20 for providing a supply of pressurized water for the apparatus. Piping 22 establishes a flow path for directing the pressurized water from pump 20 to a discharge end 24 which is located adjacent to the surface of body 14. Attached to an end of the piping 22, and having an end which defines the discharge end 24, is an assembly 26 of closely spaced tubes, which could include straw tubes. The tube assembly 26 serves to create parallel sections of flowing liquid within the flow of water which results in an exiting flow stream 27, from the discharge end 24, which has reduced edge disturbances and which therefore exhibits a highly columnarized appearance. This columnar characteristic of the flow is important to the simulation of the flying fish by providing for a highly cohesive stream of water from which the segments representing the fish are formed. Normally, pressurized fluid flowing in a pipe is subjected to a certain amount of turbulence which is characterized by non-uniformity in the flow across a given section. Upon exit from such a pipe to atmosphere, the non-uniform nature of the pressurized fluid will result in separation of the flow stream, particularly adjacent to the outer surfaces of the stream which may exhibit portions of sprayed liquid travelling in various directions. The location of the tube bundle adjacent to the discharge, reduces the separating effect characteristic of the non-uniform flow, resulting in the more cohesive flow required for the simulated fish. The cross-sectional shape of the columnarized flow of water will be determined largely by the shape of the piping at the discharge end 24. The shape may include, among others, a circular, square, triangular or oval shaped column of water. For purposes of creating the illusion of a flying fish, an oval shaped column would best serve to represent the shape of a fish.

Located adjacent to discharge end 24 is a disc 28 which is rotatably supported at a central axis and which is located such that the disc will impinge the columnar stream 27. The disc includes one or more apertures 30 which are spaced apart at a radial distance from the central axis. The disc is positioned such that the aperture, or apertures, will intermittently contact the columnar stream 27 as disc 28 rotates about the central axis. A hydraulic motor such as turbine motor 32, similar to that typically associated with pool equipment such as pool vacuuming systems, is operably connected to disc 28 to provide for the rotation of the disc. The turbine motor 32 is supplied with pressurized water from pump 20 by a divert line 34 from the piping 22. While other methods could be employed to drive the rotation of disc 28, the use of a hydraulic motor allows for a single power source associated with the pump, as opposed to separate power sources for the pump and the motor driving the disc.

As the columnar stream 27 contacts the rotating disc 28, a portion of the flow will be deflected by the disc. When an aperture 30 contacts the columnar stream, a portion of the stream will be allowed to pass through the disc generally unimpeded and will be projected toward the target 16. This will result in alternating portions of deflected and projected water. The size of the projected portions, and their frequency, will be determined by the number and size of the apertures 30, the spacing existing between the apertures, and the speed with which the disc 28 is rotating. The frequency of the fish will range between 5 to 30 fish per minute, and will most preferably range from 10 to 15 fish per minute.

A tubular spray deflector 36 is located adjacent to the downstream side of the rotating disc 28 and is aligned with the path of travel of the projected flow. As a projected portion of the columnarized water passes through the disc aperture, there may exist a certain amount of spraying associated with contact of the aperture edge with the columnarized stream. This contact with the aperture edge will exist at the leading end of the projected portion and at the trailing end of the projected portion as the aperture is rotated into, and then out of, alignment with the columnarized stream. The tubular spray deflector 36 serves to contain the spray portion which would otherwise be projected in various directions.

Figure 3A:
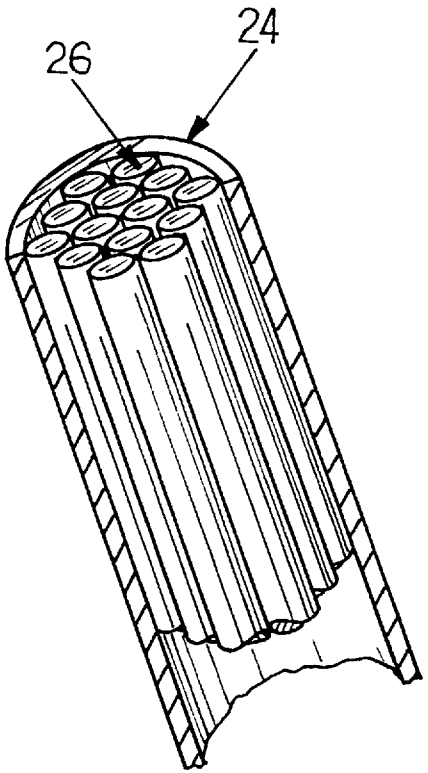
FIG. 3A is an enlarged view of the discharge end of the piping with a portion of the piping removed to show the tube bundle.
Figure 3:
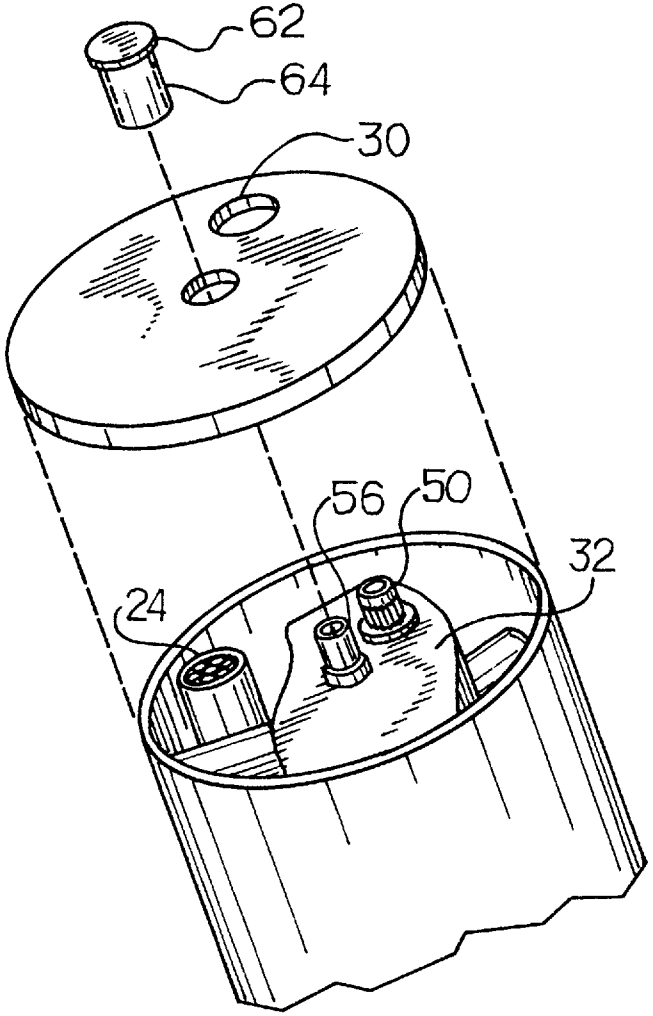
FIG. 3 is a exploded perspective view of the portion of the apparatus containing the turbine motor and disc.
Figure 5:
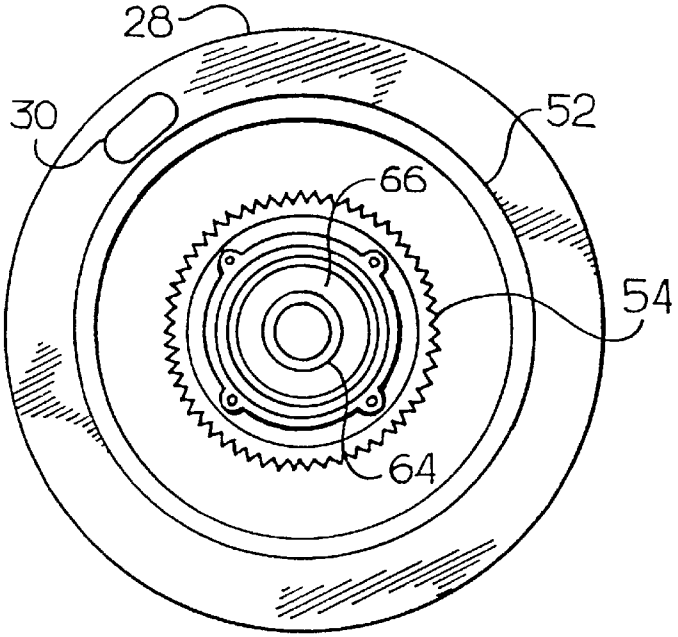
FIG. 5 is a bottom view of the disc and gear plate assembly.
Figure 4:
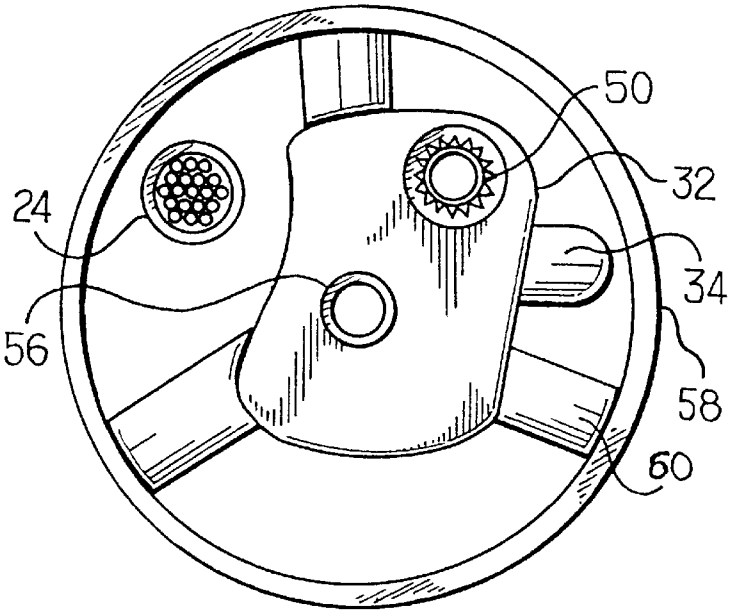
FIG. 4 is an end view of the turbine motor portion of the apparatus with the disc and gear plate removed.

Referring to FIGS. 3 through 5, the connection of the turbine motor 32 to the disc 28 is shown. The turbine motor 32, per se well known in the art, has a turbine wheel with vanes about an outer periphery which is rotated in response to pressurized water introduced to the turbine via divert line 34. Operably connected to the turbine wheel is gear 50 which extends beyond the turbine housing for rotating the disc 28. The disc 28 is attached to a gear plate 52 which carries ring gear 54 for meshing engagement with gear 50 of the turbine motor 32. As seen in FIG. 5, the gear plate 52 will have a smaller diameter than the disc 28 to provide access for the columnar stream 27 exiting from the discharge end 24 of piping 22 to contact the aperture 30. FIG. 3A shows the position of the tube bundle relative to the discharge end 24 which is adjacent to the disc 28. The use of ring gear 54 provides for rotational speed reduction from the relatively fast rotation of the turbine wheel to the desired rotational speed of the disc 28. The disc and gear plate assembly is rotatably supported on a threaded post 56 which is attached to the housing of turbine motor 32. The rotational support of the disc and gear plate is achieved through cap member 62 which has an internally threaded sleeve portion 64 for passing through the disc and gear plate and engaging the threaded post 56. Attached to the gear plate 52 is a cylinder member 66 which is capable of rotation about the sleeve portion 64 of cap member 62 passing through cylinder member 66.

FIGS. 3 and 4 show the portion of the apparatus including the turbine motor and disc contained within a housing 58, with the turbine motor supported by the housing via support members 60.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An apparatus for generating discrete portions of projected liquid for creating a visual illusion, said apparatus including:

a) a pump including a conduit for delivering a pressurized flow of an uncolumnarized liquid to an end of the conduit;

b) a flow columnarizer attached to the end of said conduit having closely spaced passages, the flow columnarizer having an elongated length sufficient to form a plurality of liquid streams for delivery from a terminal end thereof; and c) a flow trimmer including a drive, said trimmer being adjacent to the terminal end of the flow columnarizer and having at least one surface which is periodically driven into and out of an impinging relationship with the liquid streams delivered from said columnarizer for alternatively deflecting impinging liquid and creating a projected portion of the liquid streams, said projected portion of liquid having a discrete length defining an illusion for visual amusement.

2. The apparatus according to claim 1, wherein said flow columnarizer includes a bundle of tubes.

3. The apparatus according to claim 1, wherein said flow trimmer includes a motor driven rotating disc supported at a central axis having at least one aperture, the aperture being periodically aligned with the cohesive columnarized stream.

4. The apparatus according to claim 3, wherein said motor driven rotating disc has a plurality of apertures having a size and being equally spaced apart at a radius from the central axis, and wherein the rotating disc has at least one set speed of rotation such that the discrete projected portions of columnarized liquid are created at a set frequency.

5. The apparatus according to claim 4, further including a bypass line from the conduit for delivering a portion of the pressurized liquid from the conduit and wherein said motor driven rotating disc includes a hydraulic motor connected to the bypass line which is driven by the portion of said pressurized liquid.

6. The apparatus according to claim 5, further including a tubular spray deflector supportably aligned with said projected portions of columnarized liquid for containing spray associated with a leading end and an opposite trailing end of said projected portions of columnarized liquid, said spray resulting from contact of an edge of said aperture as said aperture is rotated through said cohesive columnarized stream.

7. An apparatus for simulating flying fish in a swimming pool or other body of water for visual amusement, said apparatus including:

a) a pump including a conduit for delivering a pressurized and uncolumnarized flow of water to an end of the conduit;

b) a flow columnarizer attached to the end of said conduit having closely spaced passages, the flow columnarizer having an elongated length to form a plurality of water streams for delivery to a second predetermined site from a terminal end thereof, the terminal end of the flow columnarizer being located at a first predetermined site; and c) a flow trimmer adjacent to the terminal end of the flow columnarizer, said flow trimmer including a drive and having at least one surface which is periodically driven into and out of an impinging relationship with the water streams delivered from said columnarizer for alternatively deflecting impinging water and creating a projected portion of the water streams to pass to said second predetermined site, said projected portion of water having a discrete length defining an illusion for visual amusement.

8. The apparatus according to claim 7, wherein said second body of water has an upper surface which is at an elevation above said upper surface of said first body of water.

9. The apparatus according to claim 7, wherein said flow columnarizer includes a bundle of tubes.

10. The apparatus according to claim 7, wherein said flow trimmer includes a motor driven rotating disc supported at a central axis having at least one aperture, the aperture being periodically aligned with the cohesive columnarized stream.

11. The apparatus according to claim 10 wherein said motor driven rotating disc has a plurality of apertures having a size and being equally spaced apart at a radius from the central axis, and wherein the rotating disc has at least one set speed of rotation such that the discrete projected portions of columnarized water are created at a set frequency.

12. The apparatus according to claim 10, further including a bypass line from the conduit for delivering a portion of the pressurized water from the conduit and wherein said motor driven rotating disc includes a hydraulic motor connected to the bypass line which is driven by the portion of said pressurized water.

13. The apparatus according to claim 10, further including a tubular spray deflector supportably aligned with said projected portions of columnarized water for containing spray associated with a leading end and an opposite trailing end of said projected portions of columnarized water, said spray resulting from contact of an edge of said aperture as said aperture is rotated through said cohesive columnarized stream.

14. A method for simulating a flying fish, including the steps of:

a) providing a pressurized and uncolumnarized supply of water from a first body of water using a pump having a conduit;

b) columnarizing the pressurized water by directing the water through a set of closely spaced passages connected to the conduit which are sufficiently elongated so as to create a plurality of water streams, the set of closely spaced passages having terminal ends from which a plurality of water streams are ejected; and c) trimming the columnarized water streams to create alternating deflected and generally unimpeded projected portion by periodically driving at least one surface of a flow trimmer into and out of an impinging relationship with the columnarized water streams, the projected portion targeted at a second body of water.

15. The method according to claim 14, wherein said second body of water has a surface which is at an elevation above a surface of said first body of water.

16. The method according to claim 14, wherein the set of closely spaced elongated passages consists of a tube bundle and wherein the flow trimmer includes a motor driven rotating disc supported at a central axis, the rotating disc having at least one aperture which is periodically aligned with the columnarized stream as the disc is rotated.

* * * * *

UNITED STATES PATENT AND TRADEMARK OFFICE

CERTIFICATE OF CORRECTION

PATENT NO. : 5,802,750

DATED : SEP. 8, 1998

INVENTOR(S) : PAUL F. FULMER

It is certified that error appears in the above-indentified patent and that said Letters Patent is hereby corrected as shown below:

COLUMN 1, LINE 12, delete "offend", and insert --of end--.

Signed and Sealed this

Second Day of February, 1999

*Attest:*

*Attesting Officer*

*Acting Commissioner of Patents and Trademarks*